US009381744B2

(12) United States Patent
Miyazaki

(10) Patent No.: US 9,381,744 B2
(45) Date of Patent: Jul. 5, 2016

(54) IMAGE FORMING APPARATUS INCLUDING RECOVERY DEVICE TO RECOVER DROPLET DISCHARGE HEAD

(71) Applicant: Yohei Miyazaki, Kanagawa (JP)

(72) Inventor: Yohei Miyazaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/718,419

(22) Filed: May 21, 2015

(65) Prior Publication Data

US 2015/0336387 A1 Nov. 26, 2015

(30) Foreign Application Priority Data

May 21, 2014 (JP) ..... 2014-105083
Oct. 8, 2014 (JP) ..... 2014-207106

(51) Int. Cl.
*B41J 2/165* (2006.01)

(52) U.S. Cl.
CPC ..... *B41J 2/16532* (2013.01); *B41J 2/16538* (2013.01); *B41J 2/16585* (2013.01); *B41J 2002/16591* (2013.01)

(58) Field of Classification Search
CPC ..... B41J 2/16523; B41J 2/16532; B41J 2/16508; B41J 2/1652; B41J 2/16547; B41J 2/16538; B41J 2/16585; B41J 2002/16591
USPC ..... 347/30
See application file for complete search history.

(56) References Cited

U.S. PATENT DOCUMENTS

2006/0114286 A1* 6/2006 Na ..... B41J 2/16585 347/33
2009/0244170 A1* 10/2009 Mikashima ..... B41J 2/16511 347/31

FOREIGN PATENT DOCUMENTS

| | | |
|---|---|---|
| JP | 9-220184 | 8/1997 |
| JP | 2003-159821 | 6/2003 |
| JP | 2004-284352 | 10/2004 |
| JP | 2005-107224 | 4/2005 |
| JP | 2006-212870 | 8/2006 |
| JP | 2008-188932 | 8/2008 |
| JP | 2011-025621 | 2/2011 |
| JP | 2012-166374 | 9/2012 |
| JP | 2013-233692 | 11/2013 |

* cited by examiner

*Primary Examiner* — Alessandro Amari
*Assistant Examiner* — Yaovi M Ameh
(74) *Attorney, Agent, or Firm* — Cooper & Dunham LLP

(57) ABSTRACT

An image forming apparatus includes a recovery device to recover a droplet discharge head. The recovery device includes a slider and a suction unit. The slider contacts a nozzle formation face of the droplet discharge head and moves along a nozzle row of the droplet discharge head. The slider includes two portions spaced away from each other in a direction traversing a movement direction of the slider. The suction unit opposes nozzles of the droplet discharge head and moves without contacting the nozzle formation face. The suction unit is disposed at a position between the two portions of the slider and downstream from the two portions of the slider in the movement direction of the slider. The slider collects droplets adhered to an area outside the nozzle row of the nozzle formation face.

6 Claims, 13 Drawing Sheets

IMAGE FORMING APPARATUS INCLUDING RECOVERY DEVICE TO RECOVER DROPLET DISCHARGE HEAD

CROSS-REFERENCE TO RELATED APPLICATIONS

This patent application is based on and claims priority pursuant to 35 U.S.C. §119(a) to Japanese Patent Application Nos. 2014-105083, filed on May 21, 2014, and 2014-207106, filed on Oct. 8, 2014, in the Japan Patent Office, the entire disclosure of each of which is hereby incorporated by reference herein.

BACKGROUND

1. Technical Field

Embodiments of this disclosure relate to a structure of recovering the performance of a droplet discharge head of an inkjet recording apparatus.

2. Description of the Related Art

Image forming apparatuses are used as printers, facsimile machines, copiers, or multifunction peripherals having, e.g., two or more of the foregoing capabilities. For example, an inkjet recording apparatus employing a droplet discharge head (also referred to as recording head) is known as an image forming apparatus of a liquid-discharge recording system. The inkjet recording apparatus causes droplets to adhere to a recording medium (hereinafter also referred to as sheet representing a target onto which droplets adhere and used as synonyms with recording sheet, transfer material, and so on) to form (record, or print) images, such as letters or patterns, on the recording medium while conveying the recording material.

Image forming apparatuses are used as printers, facsimile machines, copiers, or multifunction peripherals having, e.g., two or more of the foregoing capabilities. For example, an inkjet recording apparatus employing a droplet discharge head (also referred to as recording head) is known as an image forming apparatus of a liquid-discharge recording system. The inkjet recording apparatus causes droplets to adhere to a recording medium (hereinafter also referred to as sheet representing a target onto which droplets adhere and used as synonyms with recording sheet, transfer material, and so on) to form (record, or print) images, such as letters or patterns, on the recording medium while conveying the recording material.

In such an image forming apparatus of a droplet discharge system, a recording head includes multiple droplet discharge nozzles to discharge ink droplets (hereinafter referred to as droplets), and discharges ink pressurized in a pressure generation chamber, from the nozzles toward a sheet to form an image on the sheet. Accordingly, an increase in viscosity of ink due to evaporation of solvent from nozzles, solidification of ink, adhesion of dust, or introduction of bubbles may cause a discharge failure state and a recording failure. Hence, to secure stable droplet discharge performance, such an image forming apparatus generally includes a maintenance and recovery device (maintenance device) to remove droplets from a nozzle formation face (nozzle face) of the recording head.

SUMMARY

In an aspect of the present disclosure, there is provided an image forming apparatus including a recovery device to recover a droplet discharge head. The recovery device includes a slider and a suction unit. The slider contacts a nozzle formation face of the droplet discharge head and moves along a nozzle row of the droplet discharge head. The slider includes two portions spaced away from each other in a direction traversing a movement direction of the slider. The suction unit opposes nozzles of the droplet discharge head and moves without contacting the nozzle formation face. The suction unit is disposed at a position between the two portions of the slider and downstream from the two portions of the slider in the movement direction of the slider. The slider collects droplets adhered to an area outside the nozzle row of the nozzle formation face.

In an aspect of the present disclosure, there is provided an image forming apparatus including a recovery device to recover a droplet discharge head. The recovery device includes a droplet absorber and a suction unit. The droplet absorber contacts at least one of a nozzle formation face of the droplet discharge head and droplets on the nozzle formation face, moves along a nozzle row while opposing the nozzle formation face, and absorbs and removes, from of the nozzle formation face, droplets adhered to an area outside the nozzle row. The droplet absorber includes two portions spaced away from each other in a direction traversing a movement direction of the droplet absorber. The suction unit is disposed between the two portions of the droplet absorber to oppose nozzles of the droplet discharge head and move without contacting the nozzle formation face.

In an aspect of the present disclosure, there is provided an image forming apparatus including a recovery device to recover a droplet discharge head. The recovery device includes a droplet absorber and a suction unit. The droplet absorber opposes a nozzle formation face of the droplet discharge head. The suction unit contains the droplet absorber and moves along a nozzle row of the droplet discharge head. The droplet absorber includes an opposing face to oppose the nozzle formation face. The opposing face includes a first portion, a second portion, and a transition portion. The first portion opposes nozzles of the nozzle formation face. The second portion opposes an area outside the nozzles. The first portion is relatively farther from the nozzle formation face than the second portion. The transition portion between the first portion and the second portion contacts droplets on the nozzle row.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
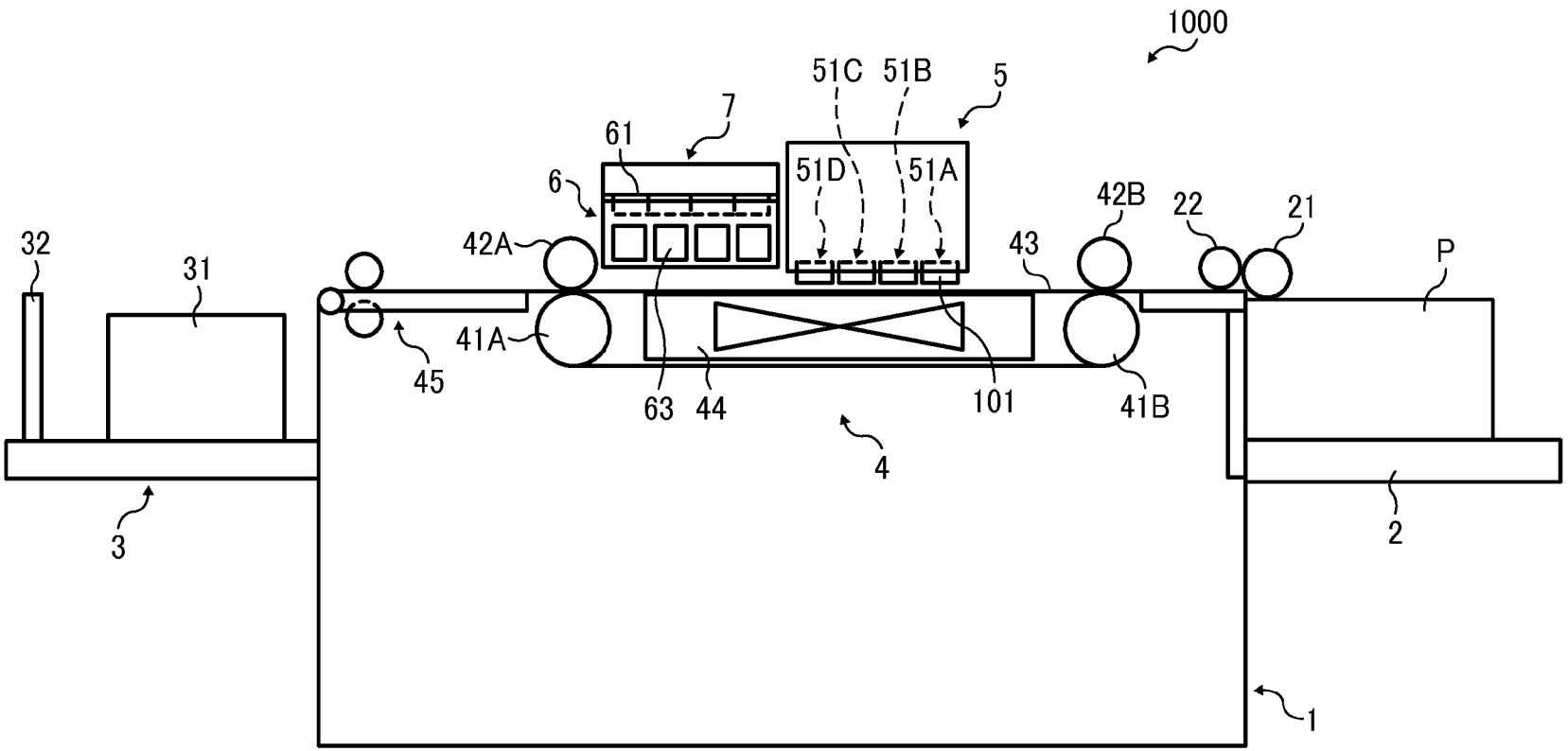
FIG. 1 is a schematic side view of an entire configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

To enhance discharge performance, a nozzle formation face of a recording head may have a liquid-repellent coating layer (liquid repellent layer). However, when a blade is used to wipe the nozzle formation face in a head cleaning for maintenance, the liquid repellent layer may be degraded. Degradation of the liquid repellent layer reduces the droplet removal and discharge performance over time, and therefore, wearing of the liquid repellent layer need be suppressed to lengthen the product life of the recording head. In particular, to remove droplets having a low surface tension and a good wettability, a contact member is pressed against the nozzle formation face of the recording head with an increased pressure, which is likely to facilitate wearing of the liquid repellent layer. Even if it is not necessary to increase the contact pressure, menisci of nozzles may not be maintained by recovery operation of the recording head depending on wettability, which may facilitate a reduction in discharge performance. Hence, to prevent a reduction in discharge performance due to degradation of the liquid repellent layer of the recording head, for example, a configuration is known that employs a system of removing droplets without contacting a nozzle formation face. However, when sucking action is used to remove droplets without contacting a nozzle formation face, a powerful drive source is needed to increase a suction force of sucking droplets.

In light of the above-described situation, embodiments of the present disclosure provide a device for recovery a droplet discharge head capable of reliably removing droplets on a nozzle formation face of a droplet discharge head and suppressing wearing of a liquid repellent layer of a nozzle vicinity area and a reduction in discharge performance over time.

Figure 2:
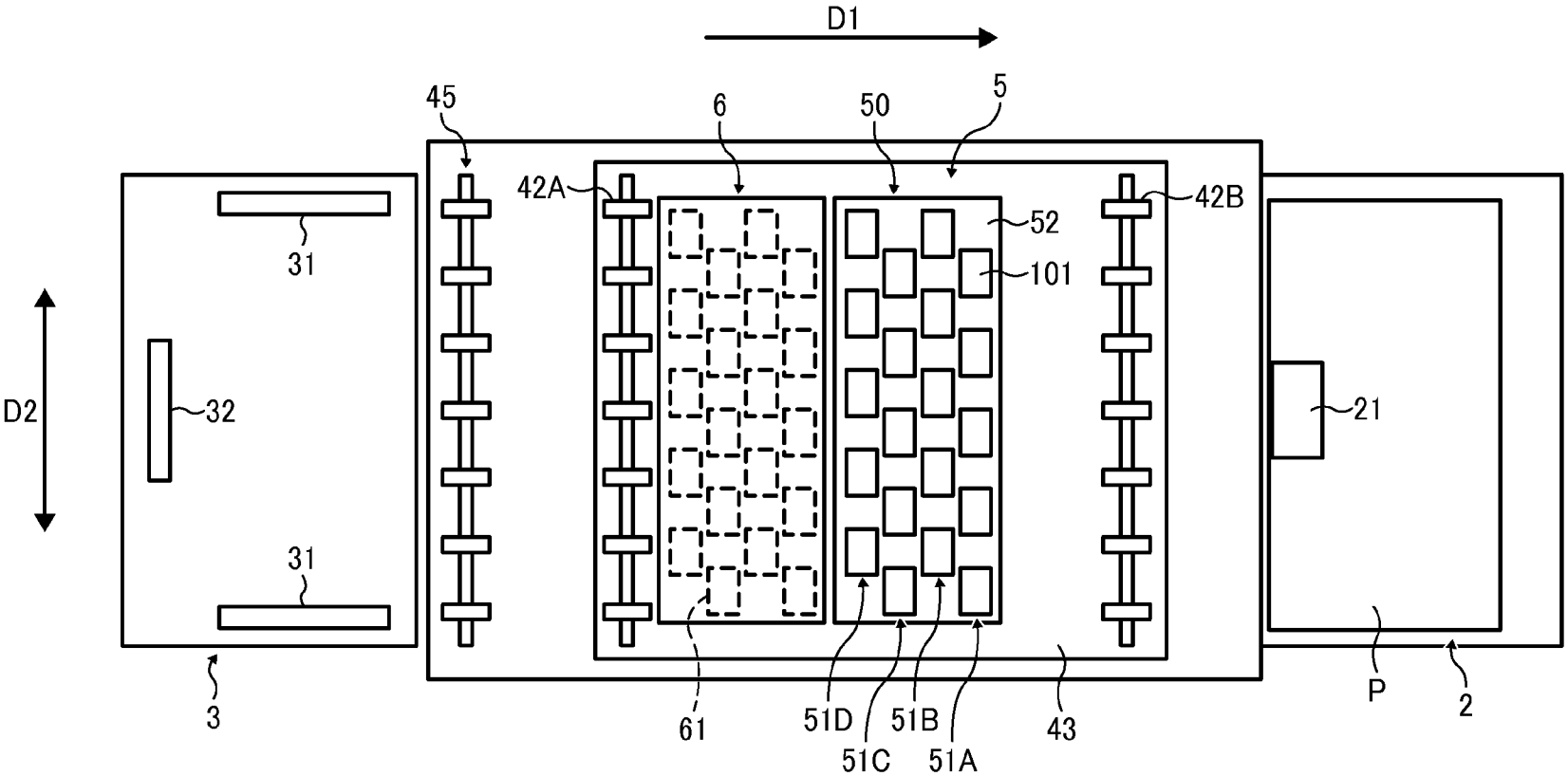
FIG. 2 is a plan view of the image forming apparatus of FIG. 1.

First, an image forming apparatus according to an embodiment of this disclosure is described with reference to FIGS. 1 and 2. FIG. 1 is a schematic side view of an entire configuration of an image forming apparatus 1000 according to an embodiment of this disclosure. FIG. 2 is a plan view of the image forming apparatus 1000.

The image forming apparatus 1000 is a line-type image forming apparatus, and includes an apparatus body 1, a sheet feed tray 2 to stack and feed sheets P, a sheet ejection tray 3 to eject and stack the sheets P after printing, and a conveyance assembly 4 to convey the sheets P. The image forming apparatus 1000 further includes a recording head 5 serving as a droplet discharge head to discharge droplets toward and print the droplets on a sheet P conveyed with the conveyance assembly 4, a maintenance device 6, and a cleaner device 7 to clean the maintenance device 6. The maintenance device 6 is a maintenance assembly to maintenance and recover head portions of the recording head 5 after an end of printing or at a desired timing.

The apparatus body 1 includes, e.g., front and rear plates and a stay. A separation roller 21 and a sheet feed roller 22 feed sheets stacked on the sheet feed tray 2 sheet by sheet toward the conveyance assembly 4.

The conveyance assembly 4 includes a conveyance driving roller 41A, a conveyance driven roller 41B, and an endless conveyance belt 43 entrained between the conveyance driving roller 41A and the conveyance driven roller 41B. A surface of the conveyance belt 43 includes multiple holes, and a suction fan 44 sucks the sheet P within a loop formed by the conveyance belt 43. Conveyance guide rollers 42A and 42B are held above the conveyance driving roller 41A and the conveyance driven roller 41B, respectively, with guides and contact the conveyance belt 43 by their weights.

The conveyance belt 43 is rotated with a motor to circulate. The sheet P is sucked onto the conveyance belt 43 with the suction fan 44 and conveyed with circulation of the conveyance belt 43. The conveyance driven roller 41B and the conveyance guide rollers 42A and 42B are rotated by circulation of the conveyance belt 43.

Above the conveyance assembly 4, the recording head 5 includes multiple head portions to discharge droplets to print an image on the sheet P, and is movably disposed (in this example, to elevate upward and downward. In maintenance and recovery operation (maintenance), the recording head 5 moves upward to a position to secure a space into which the maintenance device 6 enters below the recording head 5.

Figure 3:
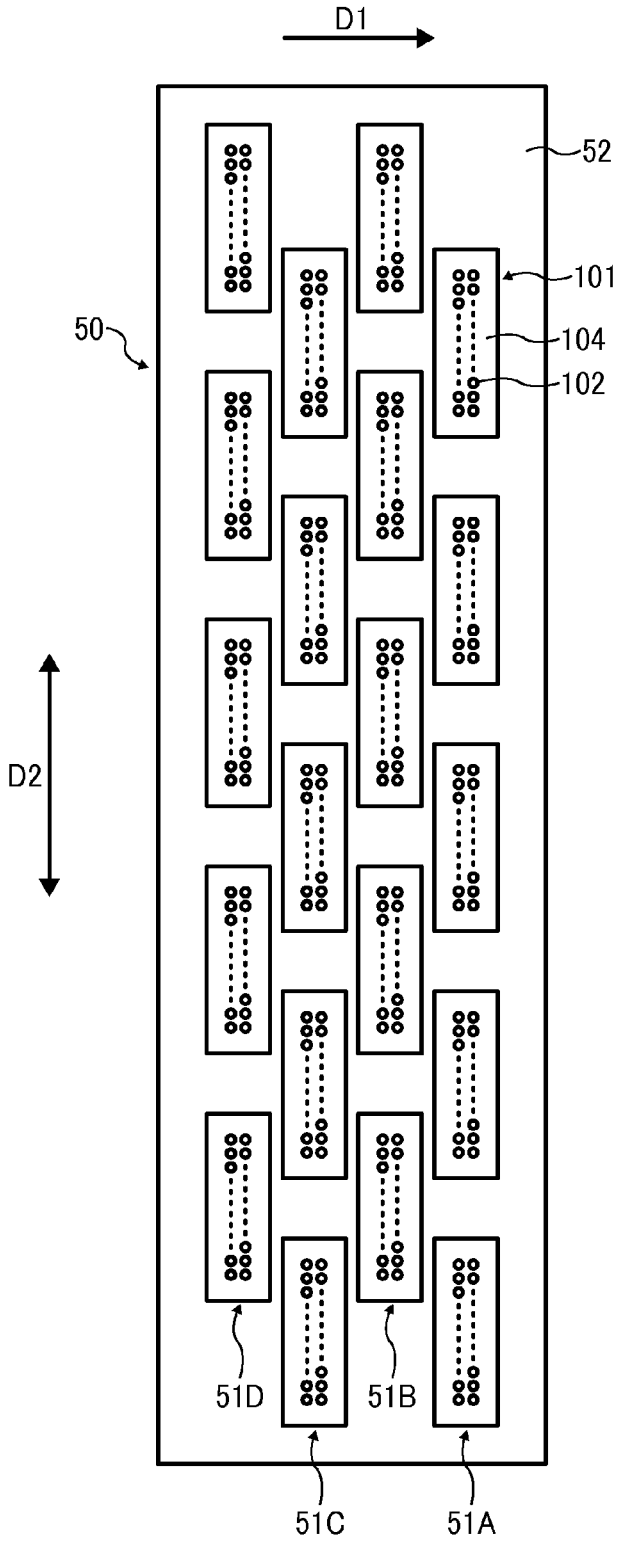
FIG. 3 is a schematic plan view of an example of a head unit of the image forming apparatus.

As illustrated in FIG. 3, the recording head 5 includes a head unit 50 including four head modules 51A to 51D (collectively referred to as head modules 51 unless distinguished). Each of the head modules 51A to 51D includes multiple (in this example, five) head portions 101 that are arranged in a row on a base 52. In each of the head portions 101, multiple nozzles 102 through which to discharge droplets are arranged in two rows in a nozzle formation face 104. For example, each of the head portions 101 of the head modules 51A and 51B discharges droplets of yellow (Y) from one of the two nozzle rows and droplets of magenta (M) from the other of the two nozzle rows. Each of the head portions 101 of the head modules 51C and 51D discharges droplets of cyan (C) from one of the two nozzle rows and droplets of black (K) from the other of the two nozzle rows. In other words, the recording head 5 has a configuration in which two head modules 51 to discharge droplets of the same color are arranged side by side in a sheet conveyance direction indicated by arrow D1 in FIG. 3 and the two head modules 51 constitute one nozzle row corresponding to the width of a sheet. In this example, the nozzle row corresponding to a single line of an image of 150 dot per inch (dpi).

The line configuration of each color is not limited to the above-described configuration, and the arrangement of colors is not limited to the above-described arrangement. The configuration of the head portions is not limited to the above-described example. For example, the above-described two head portions are arranged side by side and one color is allocated to one head row, thus obtaining an image resolution twice as much as that of the above-described configuration.

The recording head 5 includes branching portions to supply ink of respective colors to the head portions 101 of the head unit 50 and sub tanks 55 serving as liquid storage tanks upstream from the branching portions in an ink supply direction. Difference in liquid level in the sub tanks and the head portions 101 generate proper negative pressure to hold menisci of the nozzles 102 of the head portions 101. In addition, replaceable main tanks to store ink are disposed upstream from the sub tanks in the ink supply direction.

A conveyance guide 45 is disposed downstream from the conveyance assembly 4 to eject a sheet P to the sheet ejection tray 3. The sheet P conveyed with the conveyance guide 45 is ejected to the sheet ejection tray 3. The sheet ejection tray 3 includes a pair of side fences 31 and an end fence 32. The side fences 31 regulate the sheet P with respect to a width direction of the sheet P indicated by arrow D2 in FIG. 3. The end fence 32 regulates a leading end of the sheet P.

Above the conveyance assembly 4 the maintenance device 6 is disposed beside the recording head 5 to maintain the nozzle formation faces 104 of the head portions 101. The maintenance device 6 includes caps 61 to cap the nozzle formation faces 104 of the head portions 101 of the head modules 51A to 51D. The maintenance device 6 also includes a wiper blade to wipe the nozzle formation faces 104 of the head portions 101 and suction devices 63 to suck the interior of the caps 61 per one row. The maintenance device 6 sucks the interior of the caps 61 with the suction device 63 with the nozzle formation faces 104 closed with the caps 61, and thus discharges thickened ink from the nozzles 102, thus recovering the discharge performance of the head portions 10. In some embodiments, the maintenance device 6 has a configuration in which, in maintenance and recovery operation, a pressurizing device pressurizes the interior of the head portions 101 from an upstream side of the head portions 101 to a downstream side thereof instead of or together with suction. The maintenance device 6 is disposed above the conveyance assembly 4 to be slidable along the sheet conveyance direction D1. In maintenance, after moving upward, the recording head 5 moves downward and retreats to a position illustrated in FIG. 1 during printing.

The cleaner device 7 is disposed above the maintenance device 6 to clean droplets adhering to the caps 61 or the wiper blade. In a state in which the maintenance device 6 retreats to an area beside the recording head 5 after finishing the maintenance of the head portions 101, the cleaner device 7 moves downward to clean the caps 61 or the wiper blade.

Figure 4:
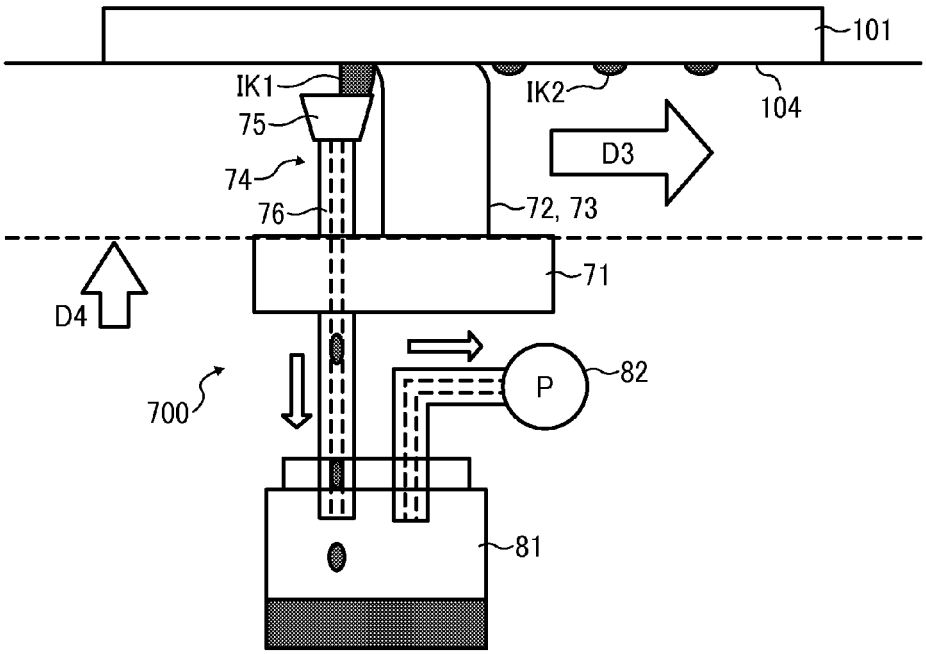
FIG. 4 is a side view of a nozzle-vicinity cleaning device seen from a longitudinal direction of a recording head.
Figure 5A:
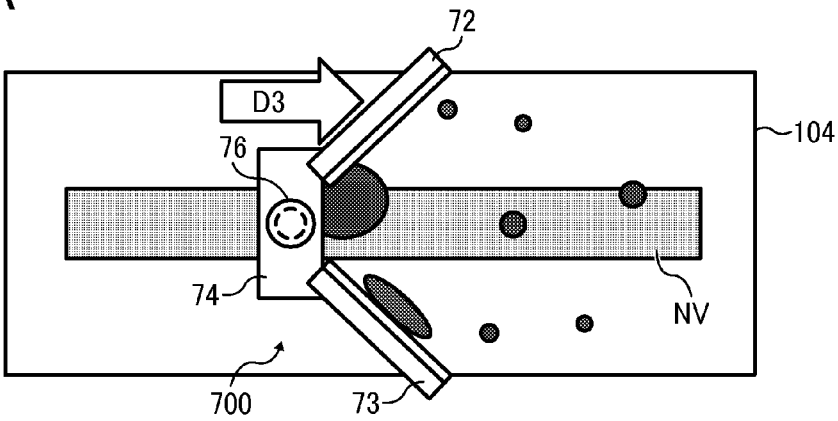
FIG. 5A is an illustration of the nozzle-vicinity cleaning device of FIG. 4 seen in a direction indicated by arrow D4 from a stage to a nozzle formation face.
Figure 5B:
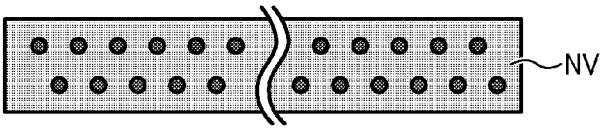
FIG. 5B is an enlarged view of a vicinity area of a nozzle row of FIG. 5A.
Figure 6:
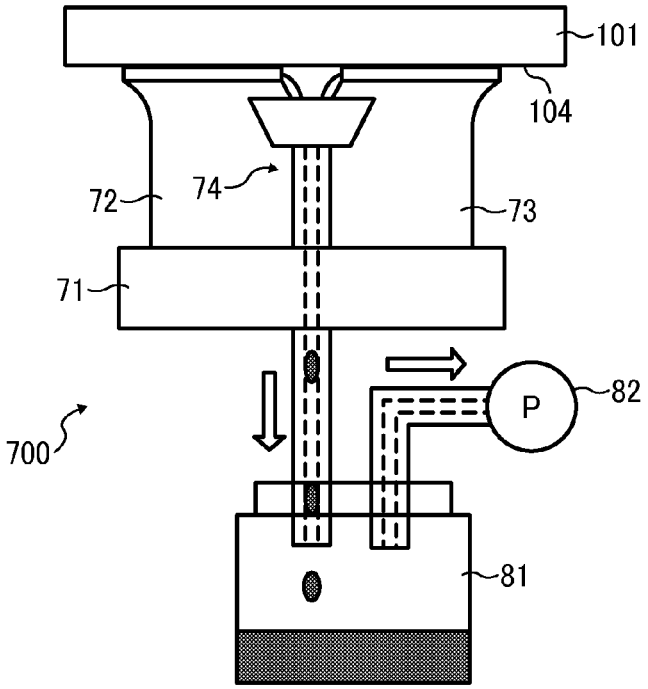
FIG. 6 is an illustration of the nozzle-vicinity cleaning device of FIG. 4 seen from a direction perpendicular to the longitudinal direction of the recording head.

Next, cleaning of a vicinity area of nozzles (hereinafter, nozzle vicinity area NV) in the nozzle formation face of the head module is described with reference to FIGS. 4, 5A, 5B, and 6. A nozzle-vicinity cleaning device 700 (droplet-discharge-head recovery device according to an embodiment of the present disclosure) to clean the nozzle vicinity area NV is provided with the maintenance device 6, and however is omitted in FIGS. 1 and 2 for convenience of drawing. The nozzle-vicinity cleaning device 700 includes a stage 71, two blades 72 and 73, and a suction unit 74. The stage 71 is movable along nozzle rows while opposing one nozzle formation face. The blades 72 and 73 are mounted on a head opposing face of the stage 71 to contact the nozzle formation face. The suction unit 74 is disposed downstream from the blades 72 and 73. The blades 72 and 73 are a flat plate of elastic material and serve as sliders disposed away from each with respect to a direction traversing a movement direction of the stage 71 indicated by arrow D3 in FIG. 4. As illustrated in FIG. 5, the blades 72 and 73 are arranged in a V shape so that outward projecting edges of the blades 72 and 73 open toward an upstream side in the movement direction D3 of the stage 71 so as to cover lateral edges of the nozzle formation face 104 of the head portion 101 of the recording head 5. In other words, an inner end of each of the blades 72 and 73 relatively closer to the suction unit 74 is disposed downstream from an outer end relatively farther from the suction unit 74 in the movement direction D3, thus forming the V shape with the two blades 72 and 73. A central portion of the V shape is discontinuous and forms an inverted V shape. As the nozzle-vicinity cleaning device 700 moves, ink IK1 adhering to an area other than a nozzle row area of the nozzle formation face 104 (outside the nozzle row) is collected to a central portion of the V shape. The suction unit 74 is disposed away at a predetermined distance from the nozzle formation face 104 at a downstream side from the discontinuous central portion of the V shape of the blades 72 and 73 in the movement direction D3 of the stage 71, to suck ink IK2 collected with the blades 72 and 73. The suction unit 74 includes a suction port 75 to suck ink without contacting the nozzle formation face 104 during operation and a tube 76 connected to the suction port 75 and supported on the stage 71. The tube 76 extends to a waste liquid tank 81, and a pump 82 provided with the waste liquid tank 81 generates a suction force in the suction unit 74. In FIG. 4, the waste liquid tank 81 and the pump 82 are illustrated below the stage 71 for convenience of illustration. However, like the maintenance device 6, during operation, the waste liquid tank 81 and the pump 82 are placed between the conveyance assembly 4 and the recording head 5. Accordingly, the waste liquid tank 81 and the pump 82 are disposed beside the stage 71 or at any other suitable positions.

The nozzle-vicinity cleaning device 700 sucks such collected ink with the suction unit 74 not contacting the nozzle formation face 104. Such a configuration suppresses degradation of a repellent layer of the nozzle formation face 104 and allows recovery of the recording head. In addition, the two blades 72 and 73 are arranged so that the outward projecting edges thereof covers lateral edges of the nozzle formation face 104. Such a configuration reliably collects ink adhering to an area outer than the nozzle vicinity area NV of FIGS. 5A and 5B. Ink is collected to a single area between the blades 72 and 73. Such a configuration can reduce the cross-sectional area of the suction port at one end of the suction unit 74, thus allowing effective use of the pump performance. Accordingly, the suction performance is enhanced, thus reliably sucking ink collected on the nozzle row.

Figure 7:
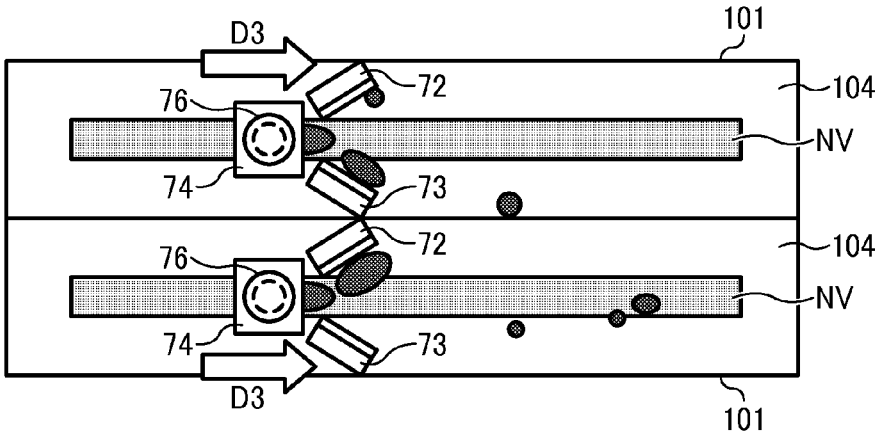
FIG. 7 is an illustration of an example in which nozzle-vicinity cleaning devices are provided corresponding to two head modules.

The nozzle-vicinity cleaning device 700 according to the above-described example is provided corresponding to the nozzle formation face 104 of one head module 51 of the head unit 50. The nozzle-vicinity cleaning device 700 moves toward the nozzle formation faces of all of the head modules 51A to 51D to perform cleaning. However, in some embodiments, the nozzle-vicinity cleaning device is provided corresponding to a plurality of or each of the head modules 51A to 51D. FIG. 7 is an illustration of an example in which nozzle-vicinity cleaning devices are provided corresponding to respective head modules. In FIG. 3, the nozzle formation faces of the head modules are offset from each other. In FIG. 7, the nozzle formation faces of the head modules are arranged side by side. The two blades 72 and 73 forming the V shape in which the blades open toward the upstream side in the movement direction D3 of the stage 71 are disposed corresponding to the nozzle formation faces of the head modules. Each suction unit 74 is placed at the central portion of the discontinuous V shape of the blades 72 and 73 to cover the nozzle row without contacting the nozzle formation face. Ink collected with the blades is sucked from the suction port of the suction unit 74.

Figure 8:
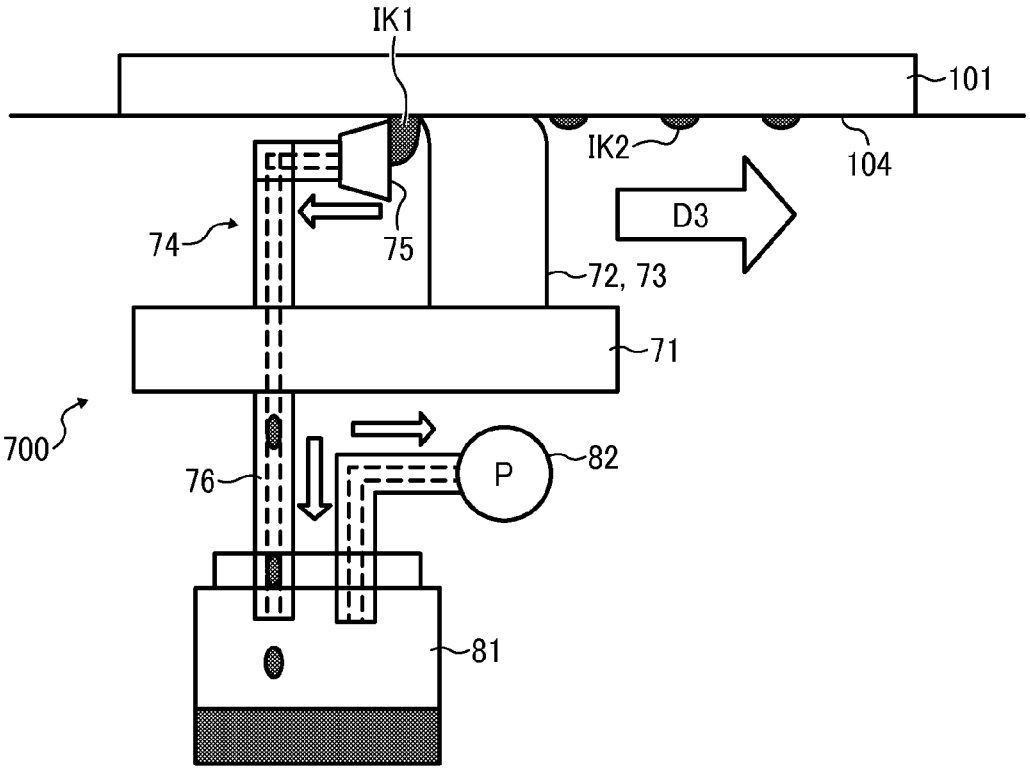
FIG. 8 is an illustration of a variation of the nozzle-vicinity cleaning device.

FIG. 8 is a side view of a variation of the nozzle-vicinity cleaning device 700. In this variation, to utilize an advantage that the blades 72 and 73 and the suction unit 74 are separate components, the projecting edge face of the suction unit 74, i.e., the suction port 75 does not oppose the nozzle formation face 104 and is directed in a movement direction D3 of the stage 71. The direction of the suction port 75 is not limited to the movement direction D3, and for example, may be somewhat angled relative to the movement direction D3. Such a configuration can suck ink adhering to the nozzle formation face 104 from a lateral direction, thus allowing suction of ink even when ink is difficult to separate from the nozzle formation face, such as when ink unsymmetrically remains on the nozzle formation face 104, droplets are minute, or droplets spread in a thin coating shape.

Figure 9:
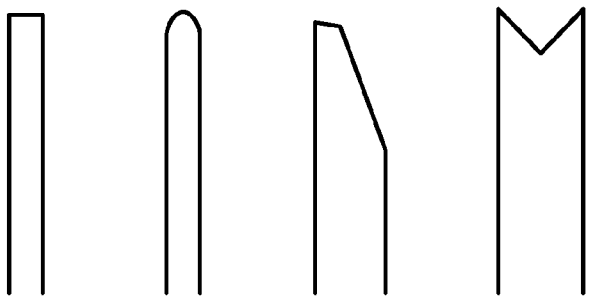
FIG. 9 is an illustration of different types of cross sections of projection ends of blades.

For the nozzle-vicinity cleaning device 700 according to the present disclosure, a channel for suction is not provided in the blade, resulting in an advantage of an increased degree of freedom in the shape of the projecting edge of the blade. Hence, the projecting edge of the blade is designed to have any one of different shapes illustrated in FIG. 9 with a priority on contactness or removability with respect to the nozzle formation face. A rubber blade having such a shape of a projecting edge can enhance the performance of collecting droplets on the nozzle row without leaving droplets on the nozzle row.

Figure 10A:
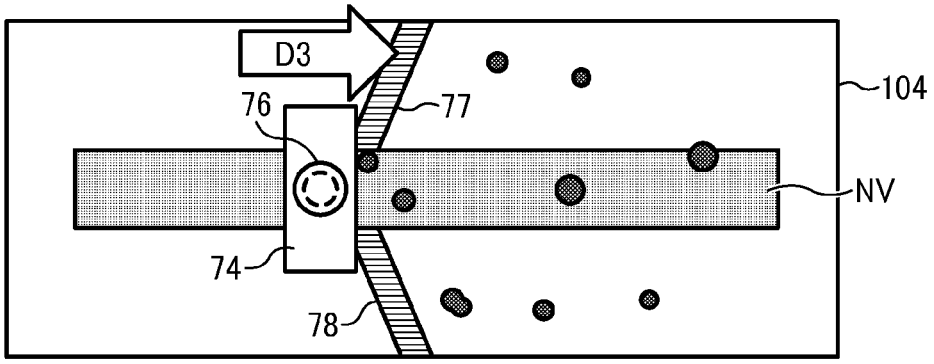
FIG. 10A is an illustration of a configuration of the nozzle-vicinity cleaning device seen in the direction from the stage to the nozzle formation face.
Figure 10B:
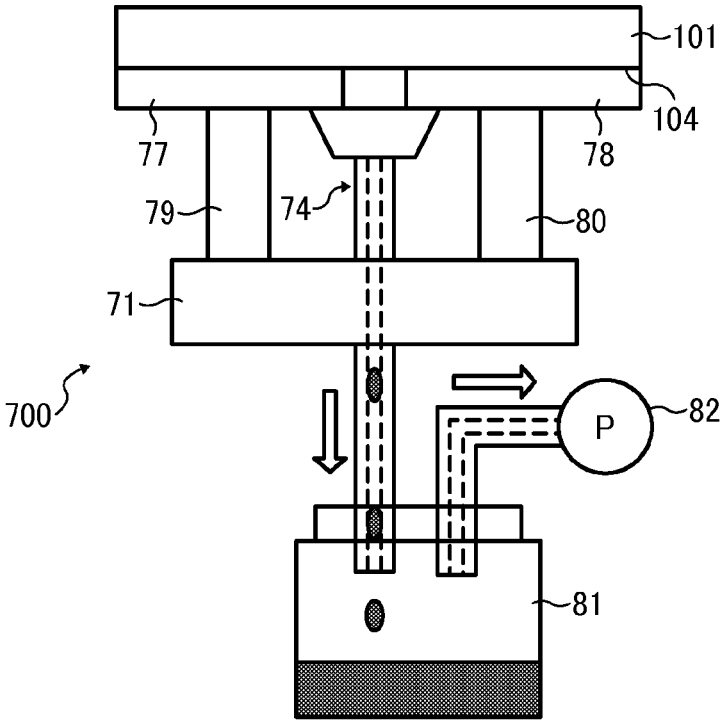
FIG. 10B is an illustration of the configuration of the nozzle-vicinity cleaning device seen in the direction perpendicular to the longitudinal direction of the recording head.

FIG. 10A and FIG. 10B are schematic views of another configuration example of the nozzle-vicinity cleaning device 700. FIG. 10B is an illustration of the nozzle-vicinity cleaning device 700 in this example, seen from a direction perpendicular to a longitudinal direction of the recording head. In this example, the nozzle-vicinity cleaning device 700 includes, instead of the two blades forming the V shape, ink absorbers 77 and 78 supported by the stage 71 via pillars 79 and 80. The ink absorbers (droplet absorbers) 77 and 78 include a material having an excellent performance of absorbing ink, such as felt. The ink absorbers 77 and 78 oppose the nozzle formation face 104 and slide against an area of the nozzle formation face outside a nozzle vicinity area NV (a vicinity area of the nozzle row) to absorb and remove ink on the area outside the nozzle vicinity area NV. A suction unit 74 opposes the nozzle vicinity area NV so as to partially overlap the ink absorbers 77 and 78 in a movement direction thereof, and sucks droplets remaining on the nozzle vicinity area NV without contacting the nozzle formation face 104. Such a configuration can remove droplets on the entire of the nozzle formation face without using blades and reducing liquid repellency on the nozzle vicinity area. In this example, only droplets remaining on the nozzle row are directly sucked. Such a configuration can reduce the cross-sectional area of the suction port at one end of the suction unit 74, thus allowing effective use of the pump performance. Accordingly, the suction performance can be enhanced.

On contacting droplets on the nozzle formation face 104 (the area outside the nozzle vicinity area), the ink absorbers in this example absorb the droplets even if the ink absorbers closely contact the nozzle formation face 104. This is because of capillary action of the ink absorbers. A portion of droplets remaining on the nozzle row (in the nozzle vicinity area) penetrates into the ink absorbers and is sucked into the suction unit 74. This is because a relatively large negative pressure is generated in the nozzle vicinity area surrounded with the suction unit 74 and the ink absorbers 77 and 78. At this time, a portion of droplets subjected to the capillary action of ink absorbers is sucked into the suction unit 74 through the ink absorbers. In consideration of such a phenomenon, the inventor of this disclosure has conceived still another configuration of the nozzle-vicinity cleaning device 700.

Figure 11:
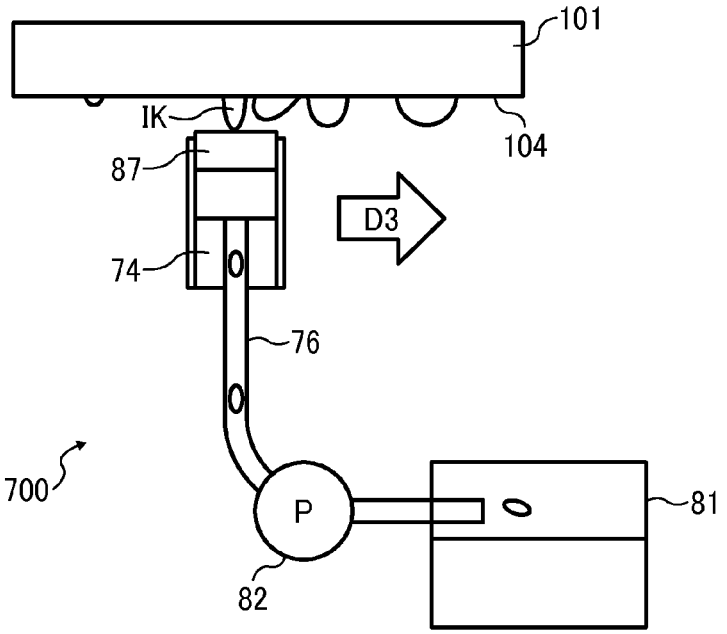
FIG. 11 is a side view of another variation of the nozzle-vicinity cleaning device seen from the longitudinal direction of the recording head.
Figure 12:
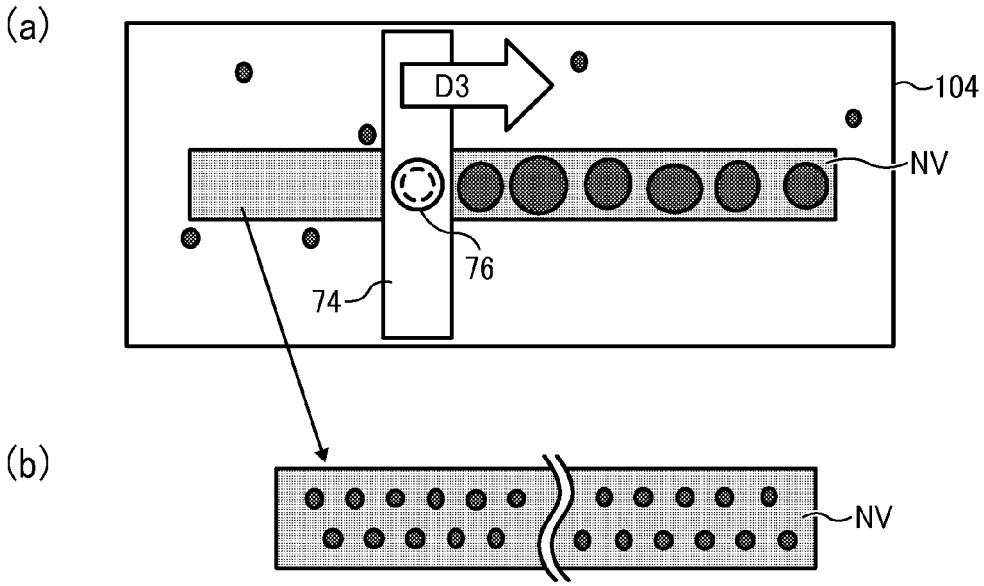
FIG. 12 shows (a) a configuration of the nozzle-vicinity cleaning device of FIG. 11 seen from the direction from the stage to the nozzle formation face and an enlarged vicinity area of a nozzle-row of (a)
Figure 20:
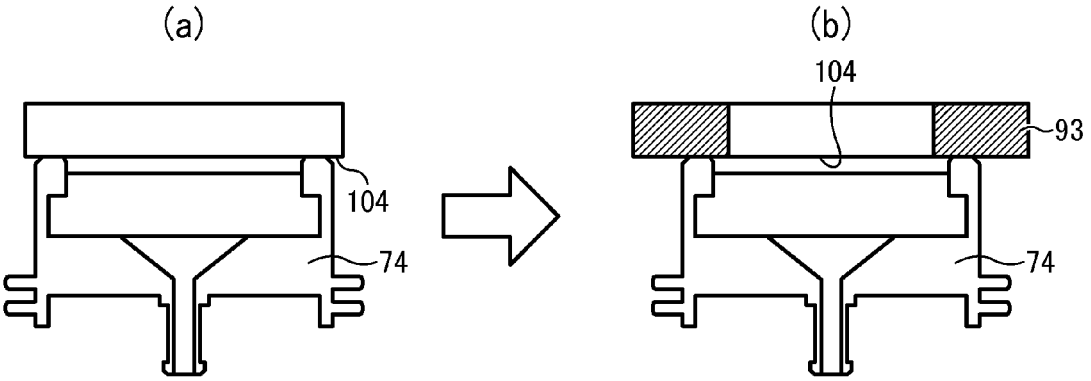
FIG. 20 is a schematic view of extensions surrounding a nozzle formation face.
Figure 21:
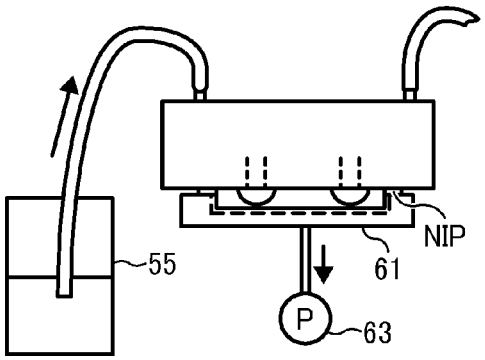
FIG. 21 is an illustration of a process of moistening a nozzle formation face by cap suction.

As illustrated in FIGS. 11 and 12, in this example, the nozzle-vicinity cleaning device 700 includes a suction unit 74 to oppose a nozzle formation face 104 of a recording head 5 and extending over an entire width of a head portion 101, and an ink absorber 87 installed in the suction unit 74. Like the example illustrated in FIGS. 4 to 6 or the variation illustrated in FIG. 10, a tube 76 is connected to the suction unit 74, extended to a waste liquid tank 81, and is provided with a pump 82. The ink absorber 87 is disposed in a suction port of the suction unit 74. An opposing face (projecting edge face) of the ink absorber 87 opposing the nozzle formation face 104 is controlled to move a nozzle row direction (a direction parallel to the nozzle row) while maintaining a distance to contact droplets IK on the nozzle formation face 104, thus sucking and removing droplets by action of capillary force and suction force. The distance control is conducted with, for example, a configuration illustrated in (a) of FIG. 20.

Figure 22:
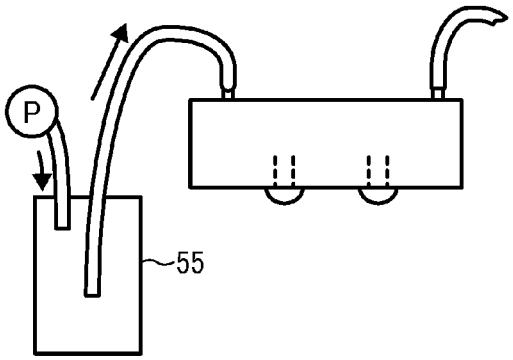
FIG. 22 is an illustration of a process of moistening a nozzle formation face by pressurization.
Figure 23:
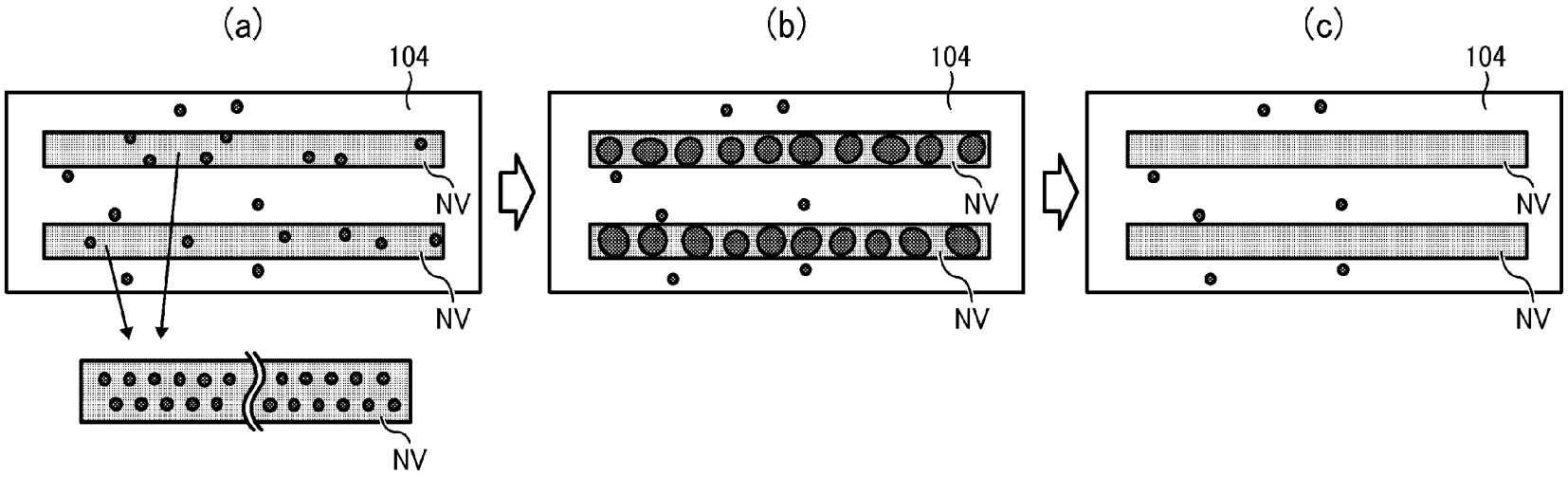
FIG. 23 shows (a) a state of a nozzle formation face after droplet discharge, (b) formation of relatively large droplets in a moistening step, and (c) a state of the nozzle formation face after recovery operation.

In the recovery operation, a process of generating a state in which the ink absorber 87 contacts droplets on the nozzle formation face 104 (nozzle vicinity area NV). Small droplets adhere on the nozzle formation face 104 after droplet discharge, and if such small droplets adhere on the nozzle vicinity area NV, such droplets may cause discharge failure. Such droplets are relatively small, and if the droplets are not dealt with, the projecting edge face of the ink absorber would not contact droplets in the nozzle vicinity area NV and may remain on the nozzle vicinity area NV. Hence, as illustrated in FIGS. 13A and 13B, the cap 61 and the suction device (pump) 63 of the maintenance device 6 are used. That is, a negative pressure is generated in the cap 61 with the suction device 63 (cap suction), and the nozzle formation face 104 is moistened with relatively large droplets. The sub tank to supply ink to the head portion serves as a liquid storage tank. Such cap suction allows the ink absorber to reliably contact droplets on the nozzle formation face 104. In some embodiments, as illustrated in FIG. 22, a pressurizer (pump) disposed upstream from a head portion pressurizes the inside of the head portion before the recovery operation, and moistens the nozzle formation face 104 with relatively large droplets. In such a process, liquid discharged from nozzles absorbs relatively small droplets, thus allowing collective removal of such small droplets (mist) which may cause discharge failure. FIG. 23 shows (a) a state of the nozzle formation face 104 after droplet discharge, (b) formation of relatively large droplets in the moistening step, and (c) a state of the nozzle formation face 104 after recovery operation.

Figure 13:
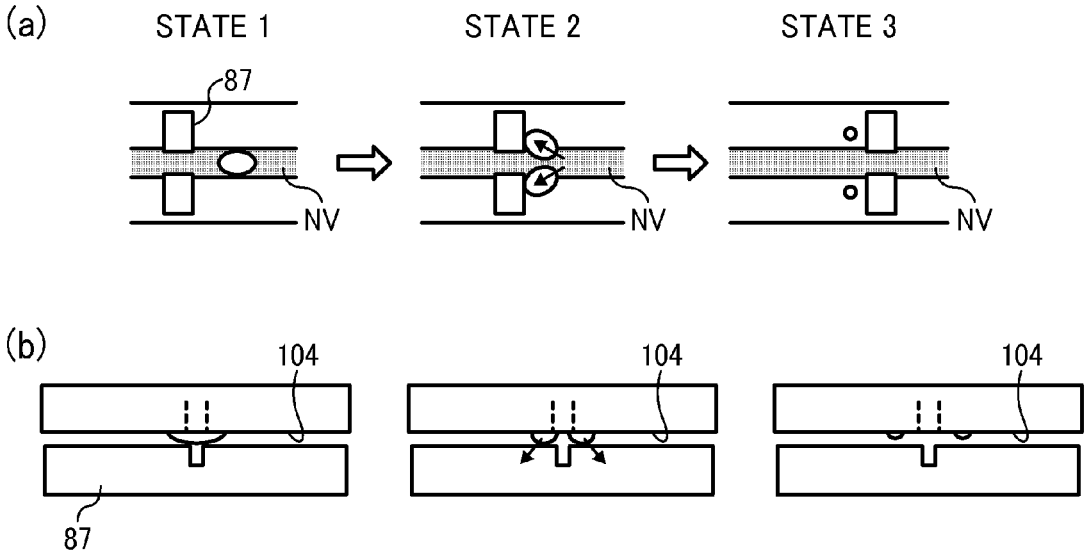
FIG. 13 shows (a) suction and removal of droplets on a vicinity area of a nozzle row in the nozzle-vicinity cleaning device of FIG. 11 seen from the direction from the stage to the nozzle formation face, and (b) suction and removal of droplets on the vicinity area of the nozzle row in the nozzle-vicinity cleaning device of FIG. 11 seen from the direction perpendicular to the longitudinal direction of the recording head.

As illustrated in (b) of FIG. 13, the ink absorber 87 has a recess in a range opposing a vicinity area of a nozzle row (nozzle vicinity area). Accordingly, a first portion of the ink absorber 87 corresponding to the nozzle vicinity area is farther away from the nozzle formation face 104 than a second portion outside the nozzle formation face 104, and inner corners corresponding to transition portions between the first portion and the second portion are placed immediately outside the nozzle vicinity area. When the nozzle-vicinity cleaning device 700 moves along a nozzle row (state 1), droplets on the nozzle vicinity area NV are attracted toward projection sides of the ink absorber 87 (state 2), and moved to an area outside the nozzle vicinity area NV (state 3). Such cleaning can secure a droplet discharge performance of the recording head even when droplets remain on the nozzle formation face 104. In the example of FIGS. 11 to 13, the opposing face of the ink absorber 87 opposing the nozzle formation face 104 is controlled to maintain a distance to contact droplets on the nozzle formation face 104. However, in an area outside the nozzle vicinity area NV, the ink absorber 87 may be slid against the nozzle formation face 104.

Figure 14:
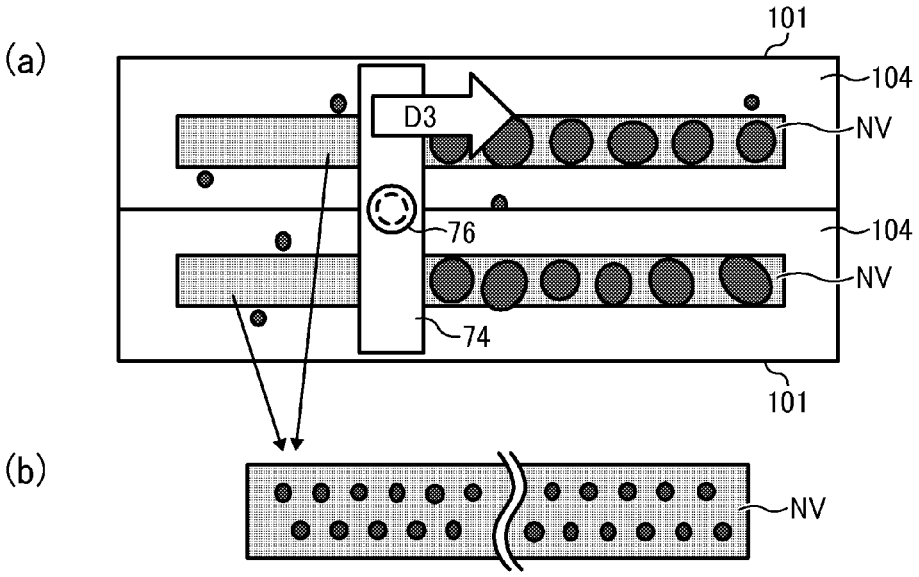
FIG. 14 shows (a) a configuration in which a nozzle-vicinity cleaning device common to two rows of head modules, seen from the direction from a stage to a nozzle formation face and (b) an enlarged vicinity area of a nozzle-row of (a)

The nozzle-vicinity cleaning device 700 illustrated in FIGS. 11 and 12 is provided corresponding to the nozzle formation face 104 of one head module. However, in some embodiments, one nozzle-vicinity cleaning device may be provided with two or more head modules. FIG. 14 is an illustration of an example of a nozzle-vicinity cleaning device common to two head modules parallel to each other. In FIG. 3, the nozzle formation faces of the head modules parallel to each other are offset from each other. By contrast, in FIG. 14, the nozzle formation faces of the head modules are arranged side by side. Alternatively, a similar nozzle-vicinity cleaning device is applicable even in a case in which multiple nozzle rows are arranged on one head module.

Figure 15:
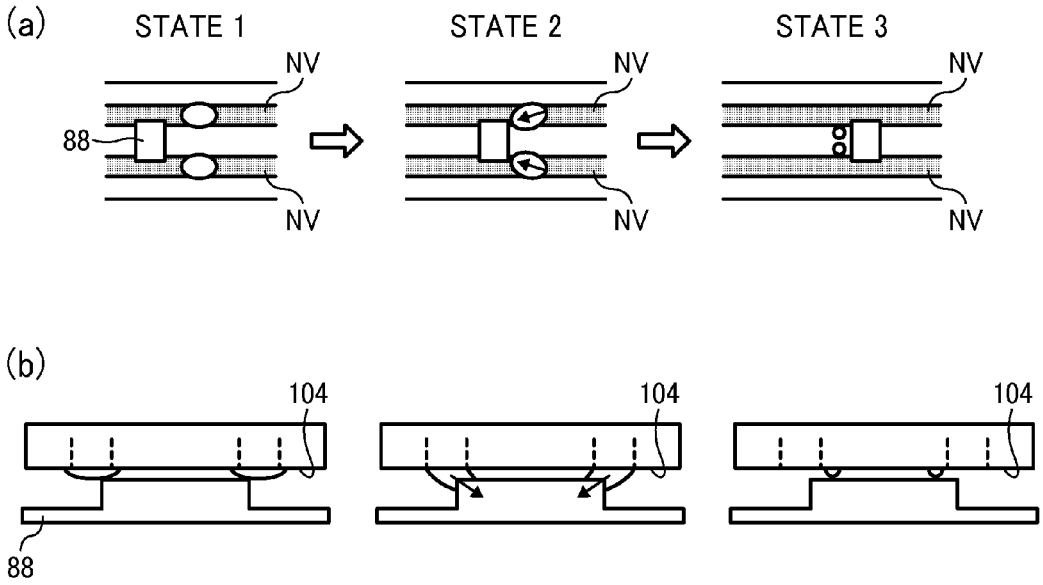
FIG. 15 shows (a) suction and removal of droplets on a vicinity area of a nozzle row in the nozzle-vicinity cleaning device of FIG. 14 seen from the direction from the stage to the nozzle formation face, and (b) suction and removal of droplets on the vicinity area of the nozzle row in the nozzle-vicinity cleaning device of FIG. 14 seen from the direction perpendicular to the longitudinal direction of the recording head.

In this example, the nozzle-vicinity cleaning device 700 includes a suction unit 74 to oppose two rows of nozzle formation faces 104 of a recording head 5 and extending over a total width of two head portions 101, and an ink absorber 88 installed in the suction unit 74. A tube is connected to the suction unit 74, extended to a waste liquid tank, and is provided with a pump, which is the same configuration as that of FIGS. 11 and 12. As illustrated in (b) of FIG. 15, the ink absorber 88 has a shape in which an area corresponding to an area between nozzle vicinity areas NV parallel to each other is relatively closer to the nozzle formation face 104 and areas corresponding to the nozzle vicinity areas NV are relatively farther from the nozzle formation face 104. In (b) of FIG. 15, areas corresponding to outer areas than the nozzle vicinity areas NV are relatively farther from the nozzle formation face 104. However, in some embodiments, the areas may be relatively closer to the nozzle formation face, like the area corresponding to the area between the nozzle vicinity areas NV.

For such a shape illustrated in (b) of FIG. 15, corner portions of the ink absorber 88 opposing the nozzle formation face 104 are positioned to partially cover the nozzle vicinity areas NV. When the nozzle-vicinity cleaning device 700 moves along a nozzle row (state 1), droplets on the nozzle vicinity area NV are attracted toward projection sides of the ink absorber 88 (state 2), and moved to an area outside the nozzle vicinity area NV (state 3). Such cleaning can secure a droplet discharge performance of the recording head even when droplets remain on the nozzle formation face 104. In the example of FIGS. 14 and 15, the opposing face of the ink absorber 88 opposing the nozzle formation face 104 is also controlled to maintain a distance to contact droplets on the nozzle formation face 104. However, in areas outside the nozzle vicinity areas NV, the ink absorber 88 may be slid against the nozzle formation face 104.

Figure 16A:
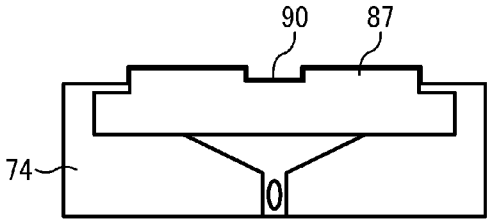
FIGS. 16A and 16B are configurations of enhancing capillary force of an ink absorber and suction force of a suction unit.
Figure 16B:
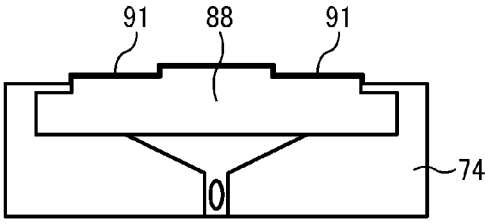

Below, a description is given of a configuration of enhancing a droplet removal performance of the nozzle-vicinity cleaning device illustrated in FIGS. 11 to 13 and the nozzle-vicinity cleaning device illustrated in FIGS. 14 and 15. To prevent the ink absorber 87 or 88 mounted at the suction port of the suction unit 74 from shifting in the suction unit 74, as illustrated in FIGS. 16A and 16B, both lateral ends of the ink absorber 87 or 88 preferably engage the suction unit 74 to be fixed and accommodated in the suction unit 74. In addition, to enhance the capillary force of the ink absorber 87 or 88 in the suction unit 74 and the suction force of the suction unit 74 relative to droplets on the nozzle formation face 104, a cover may be added to act the capillary force or the suction force on a desired area of a surface of the ink absorber 87 or 88 opposing the nozzle formation face 104. In other words, in the example of FIGS. 11 to 13, a cover 90 is mounted to cover a recess opposing the nozzle vicinity area (FIG. 16A). In the example of FIGS. 14 and 15, covers 91 are mounted on areas other than a surface area between the nozzle vicinity areas (FIG. 16B).

Figure 17:
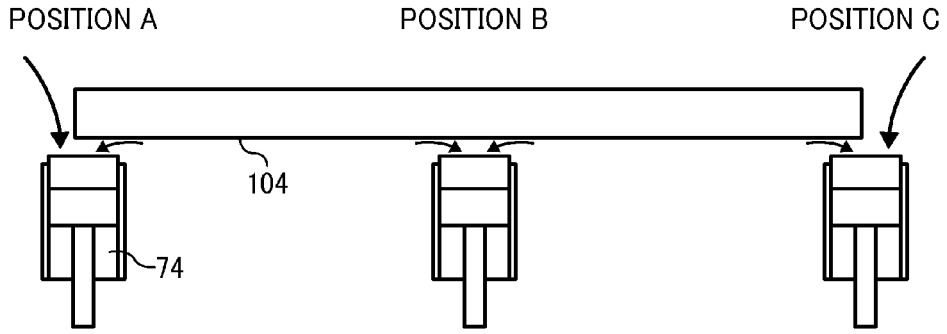
FIG. 17 is a view of a state in which, in a case in which steps are present between head portions and other portions on the base of a head unit, when an ink absorber is placed at an edge of a head portion, the ink absorber cannot maintain a negative pressure by sucking air outside a nozzle formation face.

Normally, while removing droplets, the projecting edge face of the ink absorber opposes the nozzle formation face and maintains a certain distance even when contacting the nozzle formation face, thus maintaining a constant negative pressure between the ink absorber and the nozzle formation face. However, in a case in which steps are present between the head portions and other portions on the base of the head unit (FIG. 3), when the ink absorber is placed at an edge of a head portion, the projecting edge face of the ink absorber may not oppose the nozzle formation face 104 (FIG. 17). In such a case, the ink absorber might absorb air outside the nozzle formation face 104 and might not maintain the negative pressure acting on the ink absorber, thus reducing droplet removal performance. Hence, extensions 93 are provided at both ends of the nozzle formation face to secure a sufficient nozzle formation face so that the nozzle-vicinity cleaning device does not suck excess ambient air at a start position (position A) or an end position (position C) in recovery operation (cleaning operation) (FIGS. 18 and 19).

Figure 18:
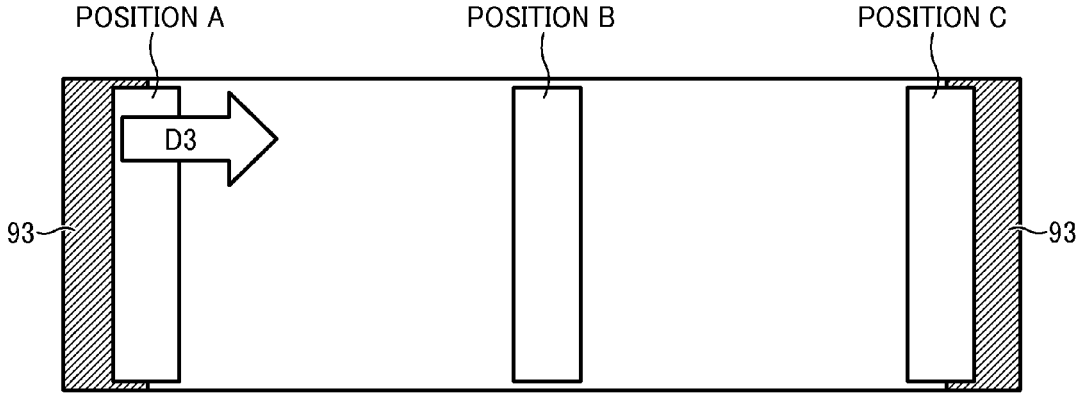
FIG. 18 is a schematic view of a configuration of preventing sucking of ambient air.
Figure 19:
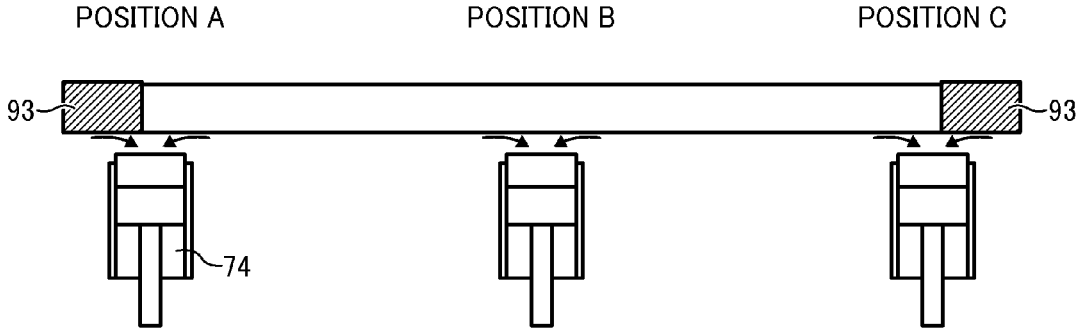
FIG. 19 is an illustration of prevention of sucking of ambient air.

As illustrated in FIG. 18, in this example, the extensions 93 are provided at both front and rear ends. However, in some embodiments, such extensions are disposed surrounding the nozzle formation face. As described above, the projecting edge face of the ink absorber is maintained at a certain distance from the nozzle formation face. As illustrated in (a) of FIG. 20, projecting ends at lateral edges of the suction unit 74 accommodating the ink absorber contact the nozzle formation face 104, thus maintaining the distance (clearance). However, in a configuration in which extensions 93 are disposed surrounding a nozzle formation face 104, projecting ends at lateral edges of the suction unit 74 contact the extensions 93. Such a configuration suppresses deforming action due to the contact on a nozzle row of the nozzle formation face, thus preventing a reduction in recovery action of the nozzle formation face.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a droplet discharge head including a nozzle formation face and one or more rows of nozzles on said nozzle formation face; and a recovery device for recovering the droplet discharge head, the recovery device including a droplet absorber to oppose the nozzle formation face of the droplet discharge head; and a suction unit to contain the droplet absorber and move along a nozzle row of the droplet discharge head to suction liquid from the nozzle formation face, the droplet absorber including an opposing face to oppose the nozzle formation face, the opposing face including a first portion to oppose the nozzles of the nozzle formation face, and a second portion to oppose an area of the nozzle formation face outside the nozzles, the second portion being disposed to have a space between the second portion and the nozzle formation face during a suction operation of the suction unit, and the first portion being disposed relatively farther from the nozzle formation face than the second portion, and inner corners formed between the first portion and the second portion and disposed close to but not in contact with the nozzle row to contact droplets on the nozzle row during a suction operation of the suction unit.

2. The image forming apparatus according to claim 1, wherein the droplet absorber opposes an area in vicinity of the nozzle row and moves droplets on the nozzle row to the second portion to remove the droplets.

3. The image forming apparatus according to claim 1, wherein the droplet absorber is positioned to cover two areas in vicinity of the nozzle row in a direction traversing a movement direction of the droplet absorber, and moves droplets on the nozzle row in the two areas to the second portion to remove the droplets.

4. The image forming apparatus according to claim 1, further comprising a cover disposed on the first portion.

5. The image forming apparatus according to claim 1, further comprising an extension attached to the nozzle formation face to maintain a negative pressure acting on the droplet absorber.

6. A device for recovering a droplet discharge head, the recovery device comprising:

a droplet absorber to oppose a nozzle formation face of the droplet discharge head; and a suction unit to contain the droplet absorber and move along a nozzle row of the droplet discharge head to suction liquid from the nozzle formation face, the droplet absorber including an opposing face to oppose the nozzle formation face, the opposing face including a first portion to oppose nozzles of the nozzle formation face, and a second portion to oppose an area of the nozzle formation face outside the nozzles, the second portion being disposed to have a space between the second portion and the nozzle formation face during a suction operation of the suction unit, and the first portion being disposed relatively farther from the nozzle formation face than the second portion, and inner corners formed between the first portion and the second portion and disposed close to but not in contact with the nozzle row to contact droplets on the nozzle row during a suction operation of the suction unit.

* * * * *